US006659718B2

(12) United States Patent
Jinnai et al.

(10) Patent No.: US 6,659,718 B2
(45) Date of Patent: Dec. 9, 2003

(54) NOZZLE ANGLE REGULATOR FOR ADJUSTABLE NOZZLE MECHANISM AND ITS PRODUCTION METHOD

(75) Inventors: Yasuaki Jinnai, Kanagawa-ken (JP); Taro Sakamoto, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 78 days.

(21) Appl. No.: 10/083,482

(22) Filed: Feb. 27, 2002

(65) Prior Publication Data

US 2002/0119041 A1 Aug. 29, 2002

(30) Foreign Application Priority Data

Feb. 27, 2001 (JP) ..... 2001-052060

(51) Int. Cl.[7] ..... F01D 17/16
(52) U.S. Cl. ..... 415/164; 29/889.22
(58) Field of Search ..... 415/163, 164, 415/150, 165; 29/888, 889.22

(56) References Cited

U.S. PATENT DOCUMENTS 4,741,666 A * 5/1988 Shimizu et al. ..... 415/158
6,050,775 A * 4/2000 Erdmann et al. ..... 415/164

* cited by examiner

*Primary Examiner*—Edward K. Look
*Assistant Examiner*—Kimya N McCoy
(74) *Attorney, Agent, or Firm*—Wenderoth, Lind & Ponack, L.L.P.

(57) ABSTRACT

The object of this invention is to propose a variable capacity turbine, requiring neither adjustment process of the full-opening position and the perfect closing position nor the dedicated full position stopper, in which the adjustment works for setting up the full-opening position of the nozzle vanes are not required, and the accidents of damaging the turbine wheel caused by the nozzle vanes which opened excessively can be avoided. It has a plurality of joint members of the same number as the nozzle vanes, which connect a plurality of nozzle shafts for nozzle vanes and the nozzle driving member, and which rotate the nozzle shafts with a swing motion forced by the nozzle driving member. The nozzle angle regulator is provided with two full-opening stopper surfaces provided on at least two neighboring joint members to move the nozzle vanes towards the opening direction and stop the nozzle vanes at the full-opening position by contacting the two neighboring joint members to each other. The nozzle angle regulator is also provided with a closing stopper surface provided on the joint member and the nozzle mount respectively, the closing stopper surfaces contact each other at the minimum opening angle position of the nozzle vanes, in which the nozzle vanes stop at the minimum opening angle position.

5 Claims, 7 Drawing Sheets

NOZZLE ANGLE REGULATOR FOR ADJUSTABLE NOZZLE MECHANISM AND ITS PRODUCTION METHOD

BACKGROUND OF THE INVENTION

1. Field of Invention

This invention, as used in the supercharger (the exhaust gas turbocharger) of internal combustion engines or the so forth, relates to the nozzle angle regulator for the adjustable nozzle mechanism of variable capacity turbines and its production method, with regard to the radial flow turbine configured to make the actuating gas flow from the spiral scroll formed in the turbine casing to the turbine rotor in the radial axis through the multiple nozzle vanes having wings of variable angle.

2. Description of the Related Art

In order to make a good match with regard to the internal combustion engine, between the outflow exhaust gas volume from the engine and the actuating gas flow volume which should be determined for the optimum operation condition of the supercharger, variable capacity superchargers, equipped with the variable capacity turbine capable of changing the exhaust gas volume to be sent from the spiral scroll to the turbine rotor in accordance with the operation condition of the engine, have been in widespread use in recent years.

A supercharger with such a variable capacity turbine is equipped with an adjustable nozzle mechanism in order to change the wing angle of the nozzle vane by rotating the nozzle vane with the link assembly so that it is capable of being driven for rotations around the turbine rotor shaft by the actuator through the actuator rod and the driving lever.

For the method to achieve assembling and adjustment of such adjustable nozzle mechanism, an invention of Japanese patent number 3,085,210 has been proposed.

In the concerned invention, a jig should be placed in the inner radius of the nozzle vane to perform the setup for perfect closing of the nozzle vane and the link assembly to be driven for rotations around the turbine rotor shaft. The jig therein can be put in contact with the rear edge of the nozzle vane, wherein the stopper pin is mounted after the nozzle vane and the lever plates are welded together upon putting the nozzle vane in contact with the jig in the state that the stopper pin, that is to be fitted into the long slots located at multiple positions along the circumferential direction of the link plate, is made non-functional or non-existing, and upon fitting the matching pin into the phase matching hole to finalize the entire link assembly in the perfect closing phase.

The position setup for full-opening of the nozzle vane and the link assembly is regulated by the stopper pin making a contact with the edge of the slot provided on the link plate. The opposite edge for the full-opening is facing the edge for regulating the perfect closing.

However, problems, such as the following, are concerned with the invention of Japanese patent number 3,085,210. The setup for the perfect closing and the full-opening positions is regulated by the stopper pin which contacts both edges of the slot. Because of this configuration, if it happens that the pin is cut or broken, or the slot is worn out or cracked down, the nozzle vanes will open more than the allowed maximum angle, and then the rear ends of the nozzle vanes will result in contacting with the turbine wheel 34. If it actually happens, the wheel will be seriously damaged.

In order to avoid such accidents, it is necessary to provide a dedicated spin stopper for the full-opening side, but it makes the configuration more complicated, and increases the number of the assembling parts.

According to the prior arts, the two different processes are required, one of which is to put the jig in contact with the nozzle vane in the nozzle vane-free state wherein the stopper pin to be fitted into the long slots of the link plate is non-functional, and the other process is, keeping the above state, to engage the phase matching hole and the phase matching pin, and set the entire link assembly in the perfect closing phase, then weld the nozzle vane and the lever plate, and fix the stopper pin. This in turn requires more assembling jigs, making the adjustable nozzle mechanism assembly and the related adjustment works troublesome, with additional man-hours resulting in increased costs.

In addition, on the basis of the conventional art in which the structure becomes complex due to the link position determining pin included therein with the stopper pin fitted into the long slot at the multiple positions in the circumferential direction of the link plate, the number of the part category and the number of the parts themselves will therefore increase considerably. As a result, the device costs will increase accordingly.

SUMMARY OF THE INVENTION

In consideration of the problems with the conventional art mentioned above, the object of this invention is to propose a variable capacity turbine, requiring neither adjustment process of the full-opening position and the perfect closing position nor the dedicated full position stopper, in which the adjustment works for setting up the full-opening position of the nozzle vanes are not required, and the accidents of damaging the turbine wheel caused by the nozzle vanes which opened excessively can be avoided. It can also simplify the adjustment process for the perfect closing and the full-opening positions, as well as lower the assembly and adjustment costs. The turbine can further simplify the structure for setting the full-opening and the perfect closing positions, and decrease the part category numbers and the number of the parts itself, thus decreasing part costs.

In order to solve the concerned problems, this invention discloses a nozzle angle regulator for adjustable nozzle mechanism, the mechanism comprising; a number of variable nozzle vanes, which are arranged along the circumference of the turbine and provided on the nozzle shafts which are supported on the nozzle mount fixed to the turbine casing in such a way that the nozzle vanes can rotate, and which vary the vane angle; a nozzle driving member having a ring shape for rotating the nozzle shafts of the nozzle vanes, the nozzle driving member being capable of rotating around the turbine shaft by the actuator; and a plurality of joint members of the same number as the nozzle vanes, which connect a plurality of nozzle shafts for nozzle vanes and the nozzle driving member, and which rotate the nozzle shafts with a swing motion forced by the nozzle driving member. This invention specially features that the nozzle angle regulator is provided with two full-opening stopper surfaces provided on at least two neighboring joint members to move the nozzle vanes towards the opening direction and stop the nozzle vanes at the full-opening position by contacting the two neighboring joint members to each other.

For the concrete configuration of the above nozzle angle regulator, a connecting portion of the joint member to couple with the nozzle shaft is provided with a chamfered stopper coupling hole having a flat or curved stopper surface on one sidewall of the stopper coupling hole, a connecting portion of the nozzle shaft to couple with the joint member is provided with a coupling shaft with a stopper surface which is corresponding to the shape of the stopper surface of the coupling hole, the coupling hole of the joint member, and the nozzle vanes and coupling shaft are engaged with each other so that the engagement creates a function to stop the relative rotation by contacting the stopper surfaces of the coupling hole and the coupling shaft setting a predetermined relationship between the engagement angle of the coupling hole and the coupling shaft; and the full-opening stopper surfaces are defined by the angle between the full-opening stopper surface and the engagement line of coupling, the coupling hole and coupling shaft when the nozzle vane is positioned at the full-opening, and the distance between the full-opening stopper surface and the shaft center of the nozzle shaft when the nozzle vane is positioned at the full-opening.

Furthermore, the nozzle angle regulator is provided with a closing stopper surface provided on the joint member and the nozzle mount respectively, the closing stopper surfaces contact each other at the minimum opening angle position of the nozzle vanes, in which the nozzle vanes stop at the minimum opening angle position.

For the concrete configuration of the above nozzle angle regulator, a connecting portion of the joint member to couple with the nozzle shaft is provided with a chamfered stopper coupling hole having a flat or curved stopper surface on one sidewall of the stopper coupling hole, a connecting portion of the nozzle shaft to couple with the joint member is provided with a coupling shaft with a stopper surface which is corresponding to the shape of the stopper surface of the coupling hole, the coupling hole of the joint member, and the nozzle vanes and coupling shaft are engaged with each other so that the engagement creates a function to stop the relative rotation by contacting the stopper surfaces of the coupling hole and the coupling shaft setting a predetermined relationship between the engagement angle of the coupling hole and the coupling shaft; and the closing stopper surfaces are defined by the angle between the closing stopper surface and the engagement line of coupling the coupling hole and coupling shaft when the nozzle vane is positioned at the perfect closing, and the distance between the perfect closing stopper surface and the shaft center of the nozzle shaft when the nozzle vane is positioned at the perfect closing.

The production method of an adjustable nozzle mechanism according to this invention, comprises the steps of: providing a connecting portion of the joint member to couple with the nozzle shaft with a chamfered stopper coupling hole having a flat or curved stopper surface on one sidewall of the stopper coupling hole; providing a connecting portion of the nozzle shaft to couple with the joint member with a coupling shaft with a stopper surface which is corresponding to the shape of the stopper surface of the coupling hole; engaging the coupling hole of the joint member, and the nozzle vanes and coupling shaft to each other so that the engagement creates a function to stop the relative rotation by contacting the stopper surfaces of the coupling hole and the coupling shaft setting a predetermined relationship between the engagement angle of the coupling hole and the coupling shaft; providing two full-opening stopper surfaces provided on at least two neighboring joint members to move the nozzle vanes towards the opening direction and stop the nozzle vanes at the full-opening position by contacting the two neighboring joint members to each other, the full-opening stopper position being defined by the angle between the full-opening stopper surface and the engagement line of coupling, the coupling hole and coupling shaft when the nozzle vane is positioned at the full-opening, and the distance between the full-opening stopper surface and the shaft center of the nozzle shaft when the nozzle vane is positioned at the full-opening; and providing the nozzle angle regulator with a closing stopper surface provided on the joint member and the nozzle mount respectively, the closing stopper surfaces to contact each other at the minimum opening angle position of the nozzle vanes, in which the nozzle vanes stop at the minimum opening angle position, the closing stopper surfaces being defined by the angle between the closing stopper surface and the engagement line of coupling the coupling hole and coupling shaft when the nozzle vane is positioned at the perfect closing, and the distance between the perfect closing stopper surface and the shaft center of the nozzle shaft when the nozzle vane is positioned at the perfect closing.

According to the invention mentioned above, the various effects are obtained as follows. By merely contacting the two full-opening stopper surfaces provided on the two assembled neighboring joint members (lever plates) respectively, the full-opening position of the nozzle vanes 2 can be provided easily without any additional full-opening regulating means, so the full-opening position for the nozzle vanes is easily set up. It is also possible to set up the minimum opening angle of the nozzle vanes merely by contacting the closing stopper surface 24 of the lever plate 1 to the stopper surface of the nozzle mount (nozzle mount stopper surface). These arrangements will simplify the assembling and adjustment works of the adjustable nozzle mechanism, and reduce the work account and cost for the adjustable nozzle mechanism.

In addition to the above, because each joint member (lever plate) is provided with the functions of regulating the full-opening position and the perfect closing position, no dedicated parts for regulating the full-opening position and the perfect closing position is required. It can also simplify the configuration, furthermore, it can reduce the category number of the parts and the parts number resulting in reducing the parts cost.

Furthermore, according to this invention, by providing the at least two full-opening stopper surfaces on the neighboring joint members (lever plates), which move toward the opening direction of the nozzle vanes, and stop the nozzle vanes at the full-opening position, the lever plates will create the flat contact at the full-opening stopper surfaces when the joint members are in the assembled phase. With this arrangement, it can avoid the accident of causing the turbine wheel to be damaged because the rear edges of the nozzle vanes contact to the turbine wheel due to the wearing out or cracking down of the full-opening position setting dedicated members such as a stopper pin or a long slot as mentioned earlier in the prior art.

Still furthermore, when the nozzle shaft for the nozzle vane assembles the fixed joint member (lever plate), the event in which each lever plate opens at the exceeding angle which is more than the full-opening angle, and it makes the assembling of the driving member (link plate) impossible, can be avoided. According to this invention, each joint member does not rotate more than the angle for the full-opening position by contacting the full-opening stopper surfaces of each other. This ensures the easy assembling of the nozzle driving member (link plate) and reduces the work counts for the assembling and adjusting the mechanism.

DETAILED DESCRIPTION OF THE PREFERRED EMBODIMENTS

In the following section we shall give a detailed explanation of the invention with reference to the drawings. In so far as the circuit components, control state, relative position of circuit components, or other features of the constitutive circuitry disclosed in this embodiment are not exhaustively delineated, they are not intended to limit the scope of the invention, but serve merely as examples to clarify the explanation.

Figure 1:
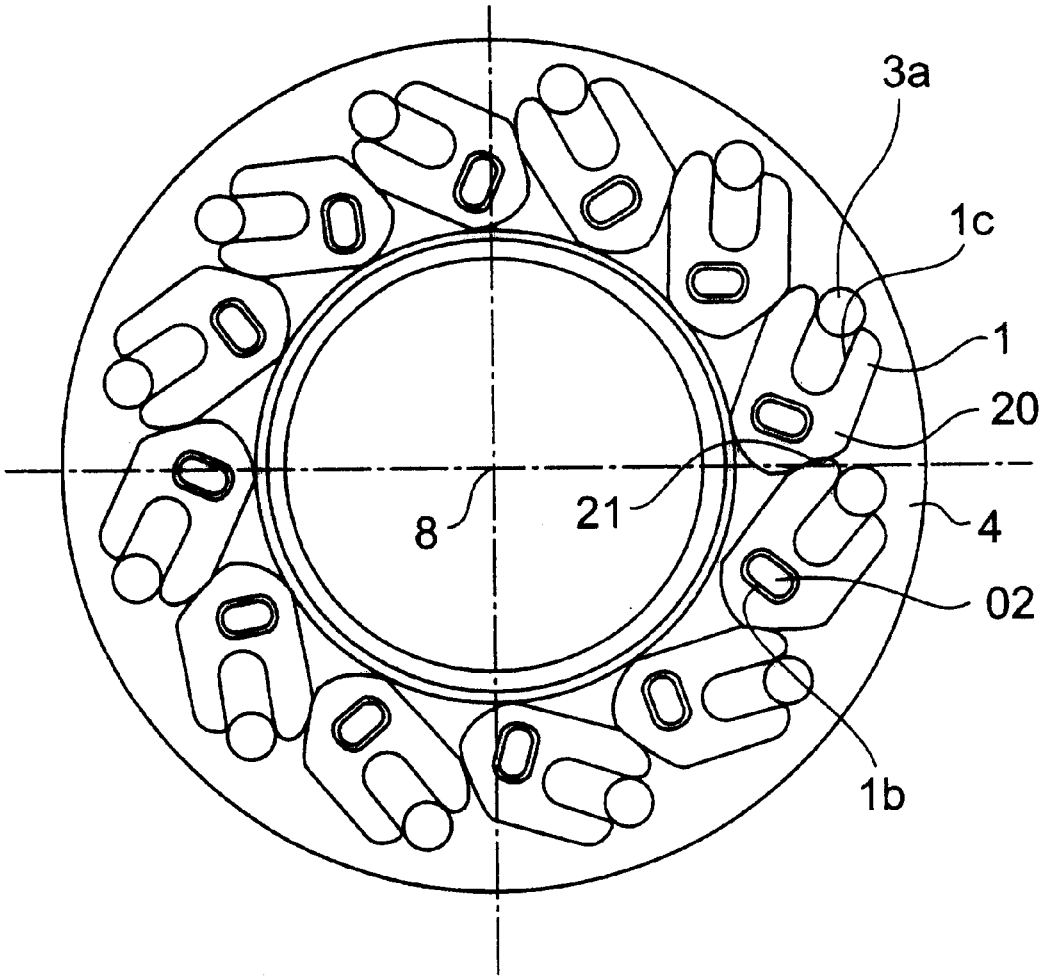
FIG. 1 shows the A—A arrowed view, the front view of FIG. 4, of the nozzle angle regulator for the adjustable nozzle mechanism used in the variable capacity turbine according to a preferred embodiment of this invention.
Figure 2:
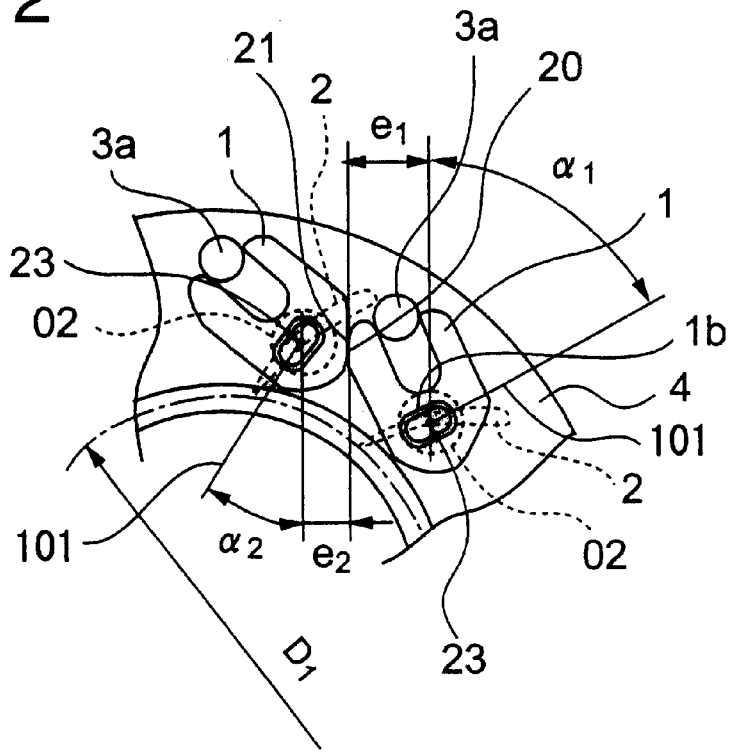
FIG. 2 shows the partial front view of a mechanism for setting the full-opening position in the nozzle angle regulator.
Figure 3:
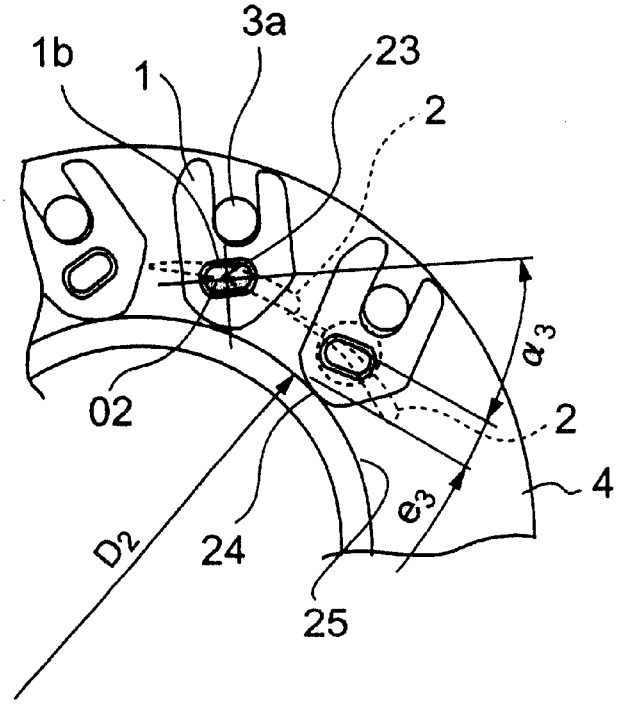
FIG. 3 shows the partial front view of a mechanism for setting the closing position in the nozzle angle regulator.
Figure 4:
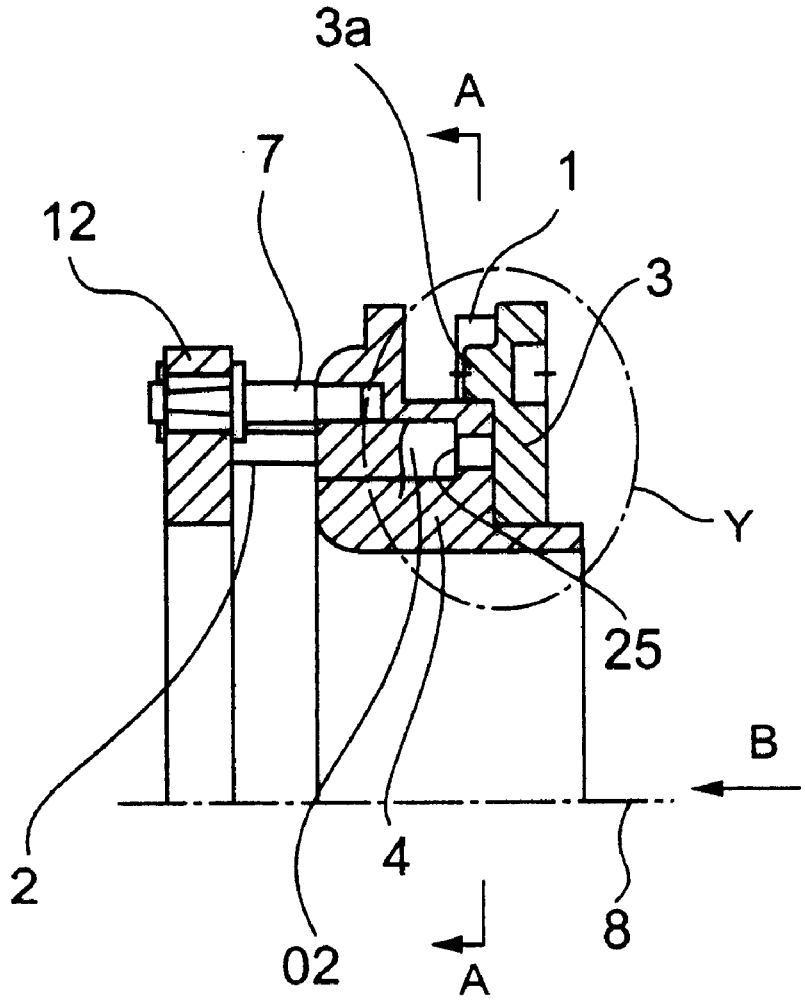
FIG. 4 shows the cross-sectional view along the rotor shaft of the adjustable nozzle mechanism, corresponding to the Z section in FIG. 6.
Figure 5:
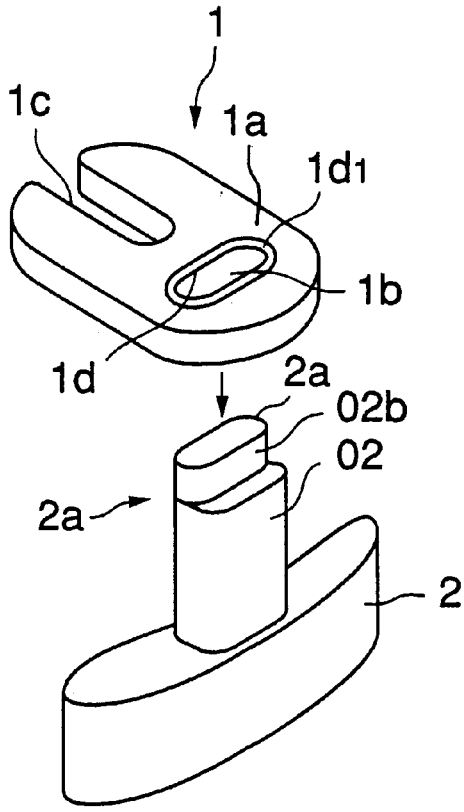
FIG. 5(A) shows the diagonal view of the coupling section of the nozzle vane and the lever plate, which has a full oblong shape.
FIG. 5(B) shows the diagonal view of the same, which has a half circle shape.
Figure 5:
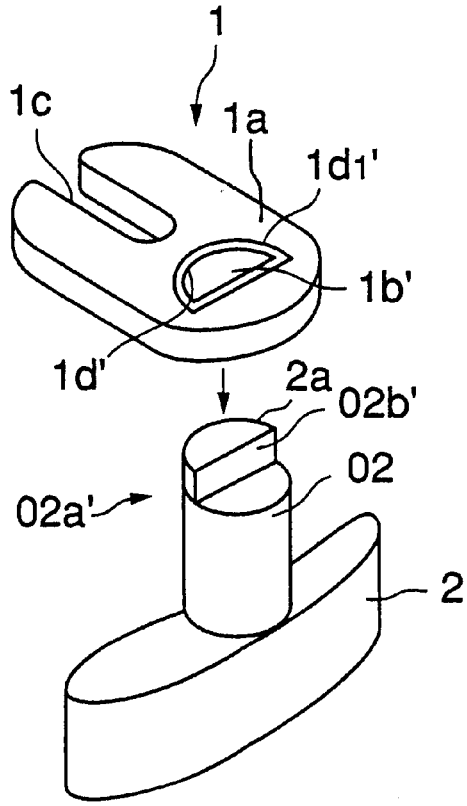
Figure 6:
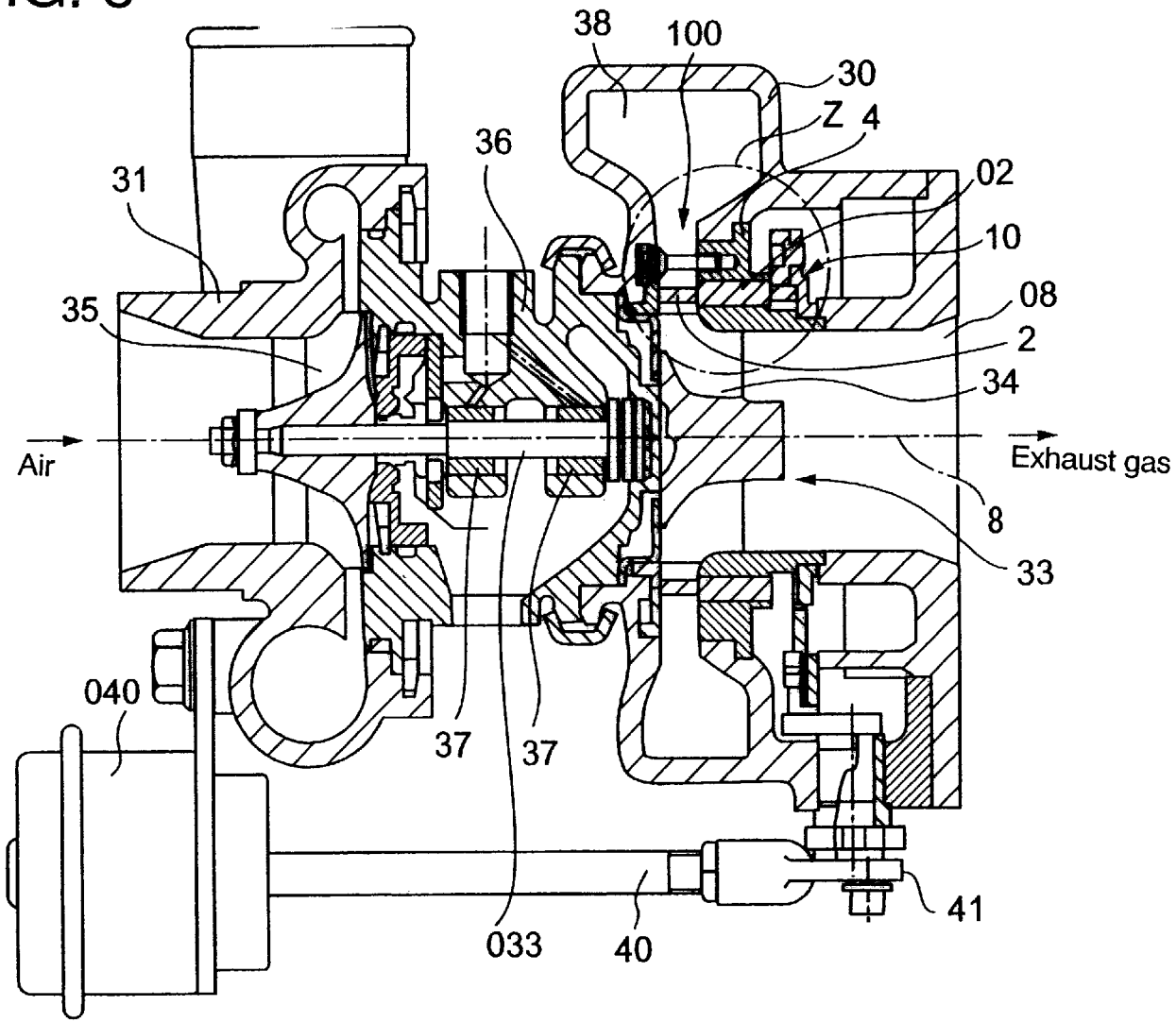
FIG. 6 shows the key cross-sectional view along the rotor shaft of the variable capacity turbine according to this invention.
Figure 7:
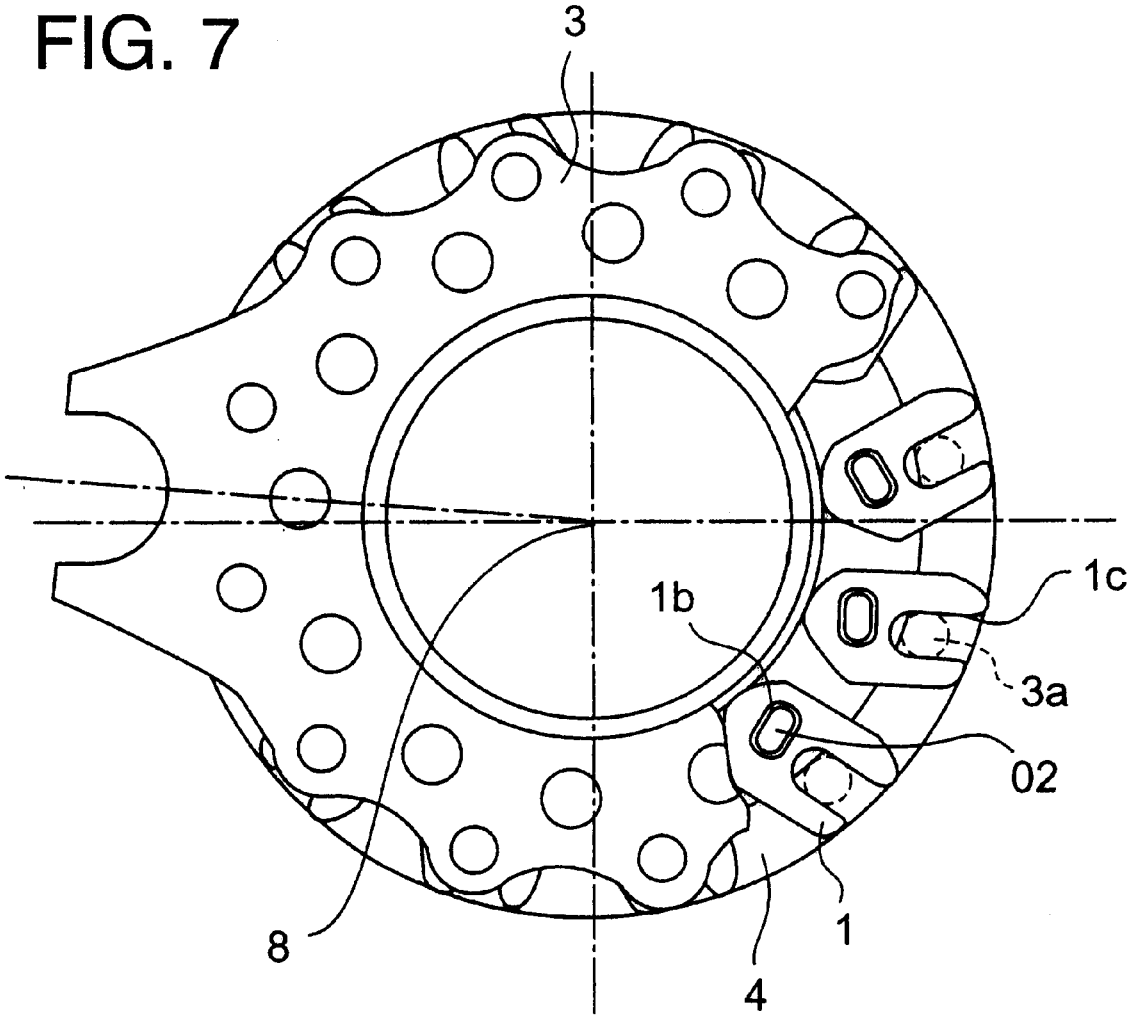
FIG. 7 shows the B-arrowed view of the above preferred embodiment shown in FIG. 4.
Figure 8:
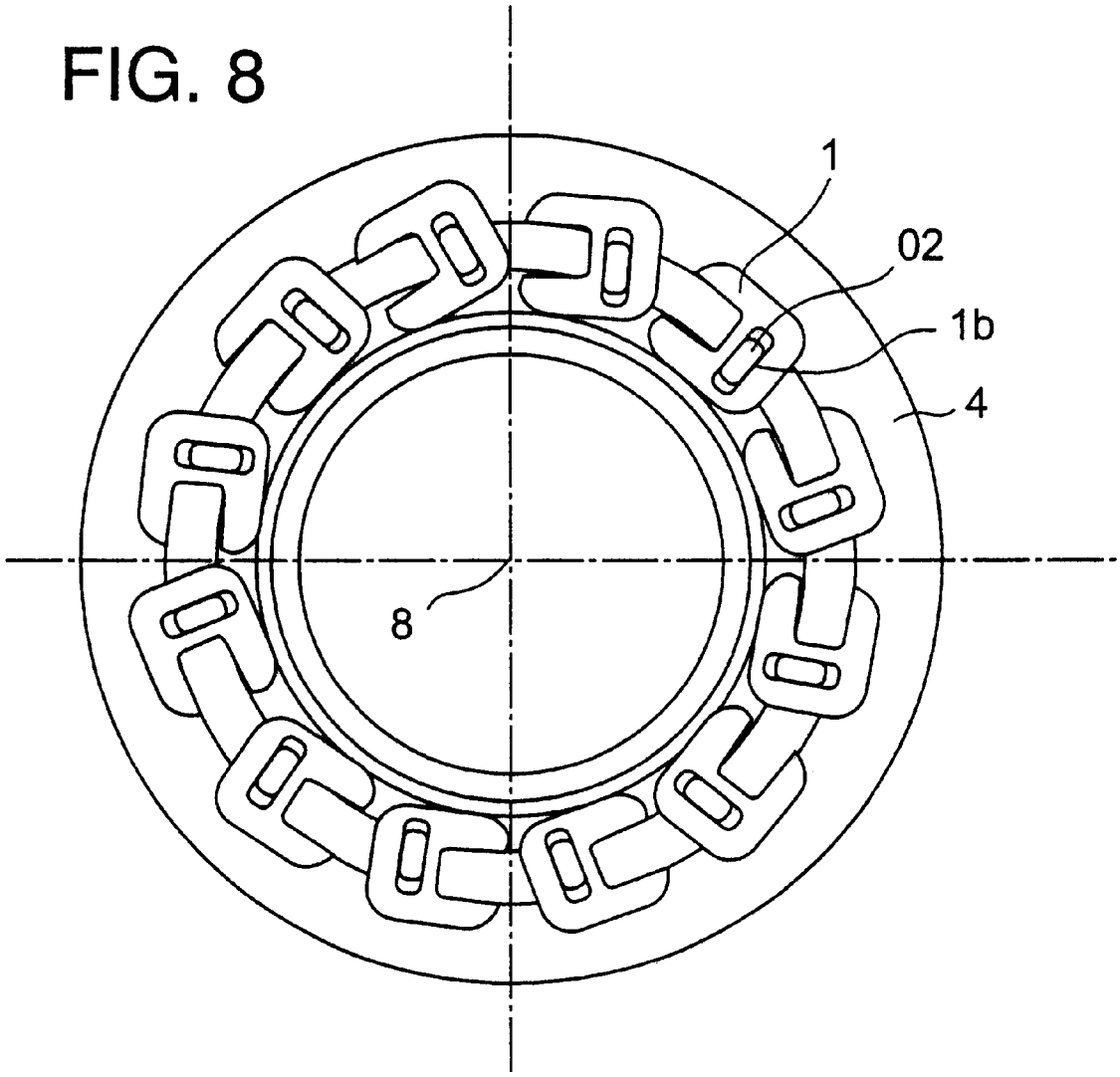
FIG. 8 shows another example for the comparison, corresponding to FIG. 1.

FIG. 1 shows the A—A arrowed view of the nozzle angle regulator for the adjustable nozzle mechanism used in the variable capacity turbine according to a preferred embodiment of this invention. FIG. 2 shows the partial front view of a mechanism for setting the full-opening position in the nozzle angle regulator. FIG. 3 shows the partial front view of a mechanism for setting the closing position in the nozzle angle regulator. FIG. 4 shows the cross-sectional view along the rotor shaft of the adjustable nozzle mechanism, corresponding to the Z section in FIG. 6. FIG. 5(A) shows the diagonal view of the coupling section of the nozzle vane and the lever plate, which has a full oblong shape. FIG. 5(B) shows the diagonal view of the same, which has a half circle shape. FIG. 6 shows the key cross-sectional view along the rotor shaft of the variable capacity turbine according to this invention. FIG. 7 shows the B-arrowed view of the above preferred embodiment shown in FIG. 4. FIG. 8 shows another example for the comparison, corresponding to FIG. 1.

In FIG. 6 showing the entire structure of the supercharger with variable capacity turbine to which this invention is applicable, 30 is the turbine casing, and 38 is the scroll formed in spiral around the circumference section in the turbine casing 30. 34 is the turbine wheel, 35 is the compressor wheel, 033 is the rotor shaft to join the turbine wheel 34 to the compressor wheel 35, both of which compose the turbine rotor 33.

08 is the exhaust gas outlet sending out the exhaust gas having done the expansion work in the turbine rotor 33. 31 is the compressor casing, 36 is the bearing housing to join the compressor casing 31 and the turbine casing 30. 37 is the bearing supporting the turbine rotor 33 as mounted on the bearing housing 36.

2 is the nozzle vane, as placed equidistant in multiple along the circumferential direction of the turbine on the inner radius of the scroll 38, and the nozzle shaft 02 formed into thereof is supported for the rotary motion by the nozzle mount 4 fixed on the turbine casing 30, the wing angle of which is changeable.

40 is the actuator rod, that is, the output end of the actuator 040 to drive the nozzle vane 2, and the reciprocating motion of the actuator rod 40 is converted through the known link mechanism including the driving lever 41 into the rotating motion to be transferred to the link plate 3 of the adjustable nozzle mechanism 100 described later.

In the supercharger with the variable capacity turbine in such configuration, the exhaust gas from the internal combustion engine (not shown in figures here) flows into the scroll 38 and goes around along the spiral of the scroll 38 further to the nozzle vane 2. The exhaust gas runs through the wings of the nozzle vane 2 to flow into the turbine rotor wheel 34 from the outer radius side thereof, and, after flowing in radial axis towards the shaft axis to perform the expansion work, flows in the shaft axis to the outside from the exhaust outlet 08.

100 is the adjustable nozzle mechanism rotating the nozzle vane 2 in order to change the wing angle thereof by use of the link plate 3 driven in rotation around the rotating shaft 8 of the turbine rotor 33 through the link mechanism, including the actuator rod 40 and the driving lever 41 from the actuator 040.

This invention relates to the nozzle angle regulator for regulating the full-opening position and the perfect closing position of the nozzle vanes 2 in the adjustable nozzle mechanism 100 and its production method, and the details of the regulator are as follows.

In FIGS. 1 to 5, and 7 showing the preferred embodiments of this invention, 3 is the link plate formed in the disk, being joined to the actuator rod 40 for rotating motion around the rotating shaft 8 through the link mechanism including the driving lever 41 as described above.

4 is the ring-shaped nozzle mount fixed on the turbine casing 30. 12 is the ring-shaped nozzle plate. 7 is the nozzle support, a plurality which are placed along the circumferential direction between the nozzle mount 4 and the nozzle plate 12 to fix the nozzle mount 4 and the nozzle plate 12.

On the other hand, the nozzle vane 2 is placed at the inner radius section of the nozzle support 7 between the nozzle mount 4 and the nozzle plate 12, and the nozzle shaft 02 fixed thereon (or formed into the nozzle vane 2) is supported for rotating motion.

1 is the lever plate to compose the joint members joining the link plate 3 to the nozzle shaft 02 on each nozzle vane 2 side, being placed equal in number to the nozzle vane 2, where one edge side thereof is fixed on the nozzle shaft 02 and the other edge side is joined to the link plate 3, as described later.

As shown in FIG. 5(A), the coupling hole 1*b* is provided through to the nozzle shaft 02 on one edge side of the lever plate 1. The coupling hole 1*b* forms a full oblong shape for engaging with stopper surface 1*d* in parallel therein onto each of the two opposite surfaces. Alternatively as shown in FIG. 5(B), the coupling hole 1*b*' can have a half circle shape for engaging with stopper 02*b*'. These holes of full oblong or half circle shape have a rotational stopper function because of the asymmetric shape in the rotational direction.

On the other hand, the coupling shaft 02*a* is provided to be fitted to the coupling hole 1*b* at the shaft edge of the nozzle shaft 02 of the nozzle vane 2. The coupling shaft 02*a* forms in the same full oblong shape as the coupling hole 1*b* to be fitted thereto, and, as the stopper surface 02*b* on shaft thereon in parallel to each other are attached to the stopper surface 1*d* in the hole. Alternatively as shown in FIG. 5(B), the coupling shaft 02*a*' forms in the same half circle shape as the coupling hole 1*d*' for a rotational stopper function. The lever plate 1 and the nozzle vane 2 are fitted firmly so as to disable the relative rotation due to the asymmetric shape in the rotational direction. In these combinations, the coupling shaft 02*a* fits into the coupling hole 1*b*, in which the stopper surface 02*b* on the shaft fits to the stopper surface 1*d* on the hole.

After the coupling shaft 02*a* is fitted to the coupling hole 1*b*, the edge portion of the coupling shaft 02*a* is processed by punching to prevent from disconnection. In this punching process, the chamfered portion $1b_1$ of the coupling hole 1*b* can prevent the punched edge portion 2*a* of the coupling shaft 02*a* from squeezing out toward the inner side surface of side surface 1*a* of the lever plate 1.

As shown in FIGS. 1, 4 and 7, on the other edge side of each lever plate 1, slot 1*c* is formed in the radial axis and the slot 1*c* is fitted with the fitting pin section 3*a* protruding towards the lever plate 3 in the same quantity as lever plate 1.

Lever plate 1 is placed between the nozzle mount 4 and the link plate 3 in the turbine shaft axis, and, as described above, the one edge side, that is the inner radius side, is fixed on the nozzle shaft 02 and the other edge side, that is the outer radius side, is fixed on the fitting pin section 3*a* of the link plate 3.

When fitting the coupling shaft section 02*a* of the nozzle vane 2 to the coupling hole 1*b* of the lever plate 1, the abovementioned stopper surface 1*d* of the coupling hole 1*b* and the stopper surface 02*b* on the coupling shaft section 02*a* are attached to be fitted after the wing angle of the nozzle vane 2 and the rotating angle of the link plate 3 are set geometrically in the required relation, and then processed for disconnection prevention by punching the edge of the coupling shaft section 02*a*. In such a punching process, the chamfered portion $1b_1$ of the coupling hole 1*b* can prevent the punched edge portion 2*a* of the coupling shaft 02*a* from squeezing out toward the inner side surface of side surface 1*a* of the lever plate 1. Thus the relative position to joint the nozzle vane 2 with a certain angle and the link plate 3 is fixed by the above joint process.

With the above joint process, the position setting of the link plate 3 is fixed to the nozzle vane 2 with a certain nozzle vane angle through the lever plate 1 by jointing the coupling shaft 02*a* of the nozzle shaft 02 into the coupling hole 1*b* of the lever plate 1. The two full-opening stopper surfaces (A)20, (B)21, and one perfect closing stopper surface 24 are created on the lever plate 1 in the following way.

As shown in FIG. 2, on the neighboring two lever plates 1, 1, which are provided spacing equally arranged along the circumference of the lever plate 1, two full-opening stopper surfaces (A)20, (B)21 are created which are in contact with each other when the lever plate 1 moves to open the nozzle vanes 2.

Among the two full-opening stopper surfaces, the full-opening stopper surface (B)21 provided at the edge of the lever plate 1 is created at the position according to the angle of $\alpha_1$ and the distance $e_1$. The angle of $\alpha_1$ is defined by the angle between this surface and the center line 101 of coupling portion coupling the coupling hole 1*b* and coupling shaft 02*a* when the nozzle vane is positioned at full-opening, and the distance $e_1$ is defined by the distance between the full-opening stopper surface (B)21 and the shaft center 23 of nozzle shaft 02 when the nozzle vane is positioned at full-opening.

The full-opening stopper surface (A)20 provided at the edge of the lever plate 1, which contacts with the full-opening stopper surface (B)21 at the full-opening position of the nozzle vane, is created at the position according to the angle of $\alpha_2$ and the distance $e_2$. The angle of $\alpha_2$ is defined by the angle between this surface and the center line 101 of coupling portion coupling the coupling hole 1*b* and coupling shaft 02*a* when the nozzle vane is positioned at full-opening, and the distance $e_2$ is defined by the distance between the full-opening stopper surface (B)21 and the shaft center 23 of nozzle shaft 02 when the nozzle vane is positioned at full-opening. $D_1$ is defined by the inner semi diameter of the rear edge of the nozzle vane 2 at the time of full-opening of the nozzle vane.

When lever plate 1 moves to the opening direction of nozzle vane 2, the two full-opening stopper surfaces (A)20, (B)21 will contact each other and then all nozzle vanes (on) arranged along the circumference will be stopped evenly at the full-opening position.

The full-opening stopper surfaces (A)20, (B)21 can be provided not only on the neighboring two lever plates 1,1, but also on all lever plates 1 or at least four lever plates.

As shown in FIG. 3, the closing stopper surface 24 is provided at the inner side of the lever plate 1. The closing stopper surface 24 is created at the position according to the angle of $\alpha_3$ and the distance $e_3$. The angle of $\alpha_3$ is defined by the angle between this closing surface and the center line 101 of coupling portion coupling the coupling hole 1*b* and coupling shaft 02*a* so that the closing stopper surface 24 contacts to the nozzle mount stopper surface 25 arranged along the circumference of the nozzle mount 4 ($D_2$ is an outer diameter of nozzle mount 4) when the nozzle vane is positioned at minimum opening angle (perfect closing position or minimum opening angle in actual use). The distance $e_3$ is defined by the distance between the closing stopper surface 24 and the shaft center 23 of nozzle shaft 02.

With the above configuration, all the closing stopper surfaces 24 on lever plates 1 will contact to the nozzle mount stopper surface 25 evenly when the nozzle vanes 2 are at the minimum opening angle.

In order to control the capacity of the variable capacity turbine equipped with the adjustable nozzle mechanism 100 in such a configuration, the wing angle of the nozzle vane 2 should be set up by means of wing angle control (not shown in figures here) to the required flow volume of the exhaust gas flowing through the nozzle vane 2 against the actuator 040. The reciprocating displacement of the actuator 040 corresponding to such wing angle is converted into rotating motion by the link mechanism including the actuator rod 40 and the driving lever 41, and transferred to the link plate 3 to drive the link plate 3 for rotation.

By the rotation of the link plate 3, each lever plate 1, joined by the fitting of fitting pin section 3*a* and slot section 1*c* to the link plate 3, is rotated around the shaft of the nozzle shaft 02 by the shift of the fitting pin section 3*a* in the circumferential direction of the rotation by the link plate 3, then the nozzle shaft 02 is rotated by the rotation of lever plate 1, and the nozzle vane 2 rotates in order to change itself to the wing angle set up by the actuator 040.

When the angle of the nozzle vane 2 is increased and reached to the angle of full-opening position, the neighboring two lever plates contact each other contacting the full-opening stopper surfaces (A)20, and (B)21, then the swing of the lever plate 1 will be stopped. This will result in locking the rotation of the link plate 3 and all the nozzle vanes 2 on the circumference will be stopped evenly.

When the angle of the nozzle vane 2 is decreased and reached to the minimum opening angle, the closing stopper surface 24 of lever plate 1 will contact to the nozzle mount stopper surface 25 of nozzle mount 4, and this will result in setting all of the nozzle vanes 2 at the minimum opening angle evenly.

According to this invention, therefore, by providing at least two full-opening stopper surfaces (A)20, (B)21 on the neighboring lever plates 1 (joint members), which move toward the opening direction of the nozzle vanes 2, and stop the nozzle vanes 2 at the full-opening position, the lever plates 1 will create the flat contact at the full-opening stopper surfaces (A)20, (B)21 when the lever plates 1 are in the assembled phase. With this arrangement, it can avoid the accident of causing the turbine wheel to be damaged because the rear edges of the nozzle vanes (inner diameter $D_1$ of nozzle vane at the full-opening position) contact to the turbine wheel due to the wearing out or cracking down of the full-opening position setting dedicated members such as a stopper pin or a long slot as mentioned earlier in the prior art.

By merely contacting the two full-opening stopper surfaces (A), (B) provided on the two assembled neighboring lever plates 1 respectively, the full-opening position of the nozzle vanes 2 can be provided easily without any additional full-opening regulating means, so the full-opening position for the nozzle vanes is easily set up. It is also possible to set up the minimum opening angle of the nozzle vanes merely by contacting the closing stopper surface 24 of the lever plate 1 to the nozzle mount stopper surface 25. These arrangements will simplify the assembling and adjustment works of the adjustable nozzle mechanism, and reduce the work account and cost for the adjustable nozzle mechanism.

In addition to the above, because each lever plate 1 is provided with the functions of regulating the full-opening position and the perfect closing position, no dedicated parts for regulating the full-opening position and the perfect closing position is required. It can also simplify the configuration, furthermore, it can reduce the category number of the parts and the parts number resulting in the reduction of the part costs.

In the comparison example shown in FIG. 8, the configuration has no full-opening stopper surfaces (A), (B) provided on the lever plate 1 disclosed in the above embodiment. Because of this configuration of the comparison example, each lever plate 1 will open at the exceeding angle which is more than the full-opening angle, and it will make the assembling of the link plate impossible, when the nozzle of the lever plate 1 already fixed with the nozzle shaft 02 of the nozzle vane 2 is assembled, due to the no full-opening regulating function on the lever plate 1. On the contrary, according to this invention, each lever plate 1 does not rotate more than the angle for the full-opening position by contacting the full-opening stopper surfaces (A)20, and (B)21 of each other. This ensures the assembling of the link plate 3 easy and reduces the work amount for the assembling and adjusting the mechanism.

According to the invention mentioned above, the various effects are obtained as follows. By merely contacting the two full-opening stopper surfaces provided on the two assembled neighboring joint members (lever plates) respectively, the full-opening position of the nozzle vanes 2 can be provided easily without any additional full-opening regulating means, so the full-opening position for the nozzle vanes is easily set up. It is also possible to set up the minimum opening angle of the nozzle vanes merely by contacting the closing stopper surface of said joint members to the stopper surface of the nozzle mount (nozzle mount stopper surface). These arrangements will simplify the assembling and adjustment works of the adjustable nozzle mechanism, and reduce the work amount and cost for the adjustable nozzle mechanism.

In addition to the above, because each joint member is provided with the functions of regulating the full-opening position and the perfect closing position, no dedicated parts for regulating the full-opening position and the perfect closing position is required. It can also simplify the configuration, furthermore, it can reduce the category number of the parts and the parts number resulting in reducing the parts cost.

Furthermore, by providing the at least two full-opening stopper surfaces on the neighboring joint members (lever plates), which move toward the opening direction of the nozzle vanes, and stop the nozzle vanes at the full-opening position, the lever plates will create the flat contact at the full-opening stopper surfaces when the joint members are in the assembled phase. With this arrangement, it can avoid the accident of causing the turbine wheel to be damaged because the rear edges of the nozzle vanes contact to the turbine wheel due to the wearing out or cracking down of the full-opening position setting dedicated members such as a stopper pin or a long slot as mentioned earlier in the prior art.

Still furthermore, when the nozzle shaft for the nozzle vane assembles the joint member (lever plate), the event in which each lever plate opens at the exceeding angle which is more than the full-opening angle, and in which it makes the assembling of the link plate impossible, can be avoided. According to this invention, each joint member does not rotate more than the angle for the full-opening position by contacting the full-opening stopper surfaces of each other. This ensures the easy assembling of the nozzle driving member (link plate) and reduces the work counts for the assembling and adjusting the mechanism.

What is claimed is:

1. A nozzle angle regulator for adjustable nozzle mechanism, said mechanism comprising; a number of variable nozzle vanes, which are arranged along the circumference of the turbine and provided on the nozzle shafts which are supported on the nozzle mount fixed to the turbine casing in such a way that the nozzle vanes can rotate, and which vary the vane angle; a nozzle driving member having a ring shape for rotating the nozzle shafts of the nozzle vanes, the nozzle driving member being capable of rotating around the turbine shaft by the actuator; and a plurality of joint members of the same number as the nozzle vanes, which connect a plurality of nozzle shafts for nozzle vanes and the nozzle driving member, and which rotate the nozzle shafts with a swing motion forced by the nozzle driving member:

wherein said nozzle angle regulator is provided with two full-opening stopper surfaces provided on at least two neighboring joint members to move said nozzle vanes towards the opening direction and stop said nozzle vanes at the full-opening position by contacting said two neighboring joint members to each other.

2. A nozzle angle regulator according to claim 1:

wherein a connecting portion of said joint member to couple with said nozzle shaft is provided with a chamfered stopper coupling hole having a flat or curved stopper surface on one sidewall of said stopper coupling hole, a connecting portion of said nozzle shaft to couple with said joint member is provided with a coupling shaft with a stopper surface of the shaft which is corresponding to the shape of said stopper surface of said coupling hole, said coupling hole of said joint member, and said nozzle vanes and coupling shaft are engaged with each other so that said engagement creates a function to stop the relative rotation by contacting said stopper surfaces of said coupling hole and said coupling shaft setting a predetermined relationship between the engagement angle of said coupling hole and said coupling shaft; and wherein said full-opening stopper surfaces are defined by the angle between said full-opening stopper surface and the engagement line of coupling, said coupling hole and coupling shaft when said nozzle vane is set at the full-opening position, and the distance between said full-opening stopper surface and the shaft center of said nozzle shaft when said nozzle vane is set at the full-opening position.

3. A nozzle angle regulator for adjustable nozzle mechanism, said mechanism, comprising; a number of variable nozzle vanes, which are arranged along the circumference of the turbine and provided on the nozzle shafts which are supported on the nozzle mount fixed to the turbine casing in such a way that the nozzle vanes can rotate, and which vary the vane angle; a nozzle driving member having a ring shape for rotating the nozzle shafts of the nozzle vanes, the nozzle driving member being capable of rotating around the turbine shaft by the actuator; and a plurality of joint members of the same number as the nozzle vanes, which connect a plurality of nozzle shafts for nozzle vanes and the nozzle driving member, and which rotate the nozzle shafts with a swing motion forced by the nozzle driving member:

wherein said nozzle angle regulator is provided with closing stopper surfaces provided on said joint member and said nozzle mount respectively, said closing stopper surfaces contact each other at the minimum opening angle position of said nozzle vanes, in which said nozzle vanes stop at the minimum opening angle position.

4. A nozzle angle regulator according to claim 3:

wherein a connecting portion of said joint member to couple with said nozzle shaft is provided with a chamfered stopper coupling hole having a flat or curved stopper surface on one sidewall of said stopper coupling hole, a connecting portion of said nozzle shaft to couple with said joint member is provided with a coupling shaft with a stopper surface which is corresponding to the shape of said stopper surface of said coupling hole, said coupling hole of said joint member, and said nozzle vanes and coupling shaft are engaged with each other so that said engagement creates a function to stop the relative rotation by contacting said stopper surfaces of said coupling hole and said coupling shaft setting a predetermined relationship between the engagement angle of said coupling hole and said coupling shaft; and wherein said closing stopper surfaces are defined by the angle between said closing stopper surface and the engagement line of coupling said coupling hole and coupling shaft when said nozzle vane is set at the minimum opening position, and the distance between said closing stopper surface and the shaft center of said nozzle shaft when said nozzle vane is set at the minimum opening angle position.

5. A production method of an adjustable nozzle mechanism, said mechanism comprising; a number of variable nozzle vanes, which are arranged along the circumference of the turbine and provided on the nozzle shafts which are supported on the nozzle mount fixed to the turbine casing in such a way that the nozzle vanes can rotate, and which vary the vane angle; a nozzle driving member having a ring shape for rotating the nozzle shafts of the nozzle vanes, the nozzle driving member being capable of rotating around the turbine shaft by the actuator; and a plurality of joint members of the same number as the nozzle vanes, which connect a plurality of nozzle shafts for nozzle vanes and the nozzle driving member, and which rotate the nozzle shafts with a swing motion forced by the nozzle driving member, said method comprising the steps of:

providing a connecting portion of said joint member to couple with said nozzle shaft with a chamfered stopper coupling hole having a flat or curved stopper surface on one sidewall of said stopper coupling hole;

providing a connecting portion of said nozzle shaft to couple with said joint member with a coupling shaft with a stopper surface which is corresponding to the shape of said stopper surface of said coupling hole;

engaging said coupling hole of said joint member, and said nozzle vanes and coupling shaft to each other so that said engagement creates a function to stop the relative rotation by contacting said stopper surfaces of said coupling hole and said coupling shaft setting a predetermined relationship between the engagement angle of said coupling hole and said coupling shaft;

providing two full-opening stopper surfaces provided on at least two neighboring joint members to move said nozzle vanes towards the opening direction and stop said nozzle vanes at the full-opening position by contacting said two neighboring joint members to each other, said full-opening stopper position being defined by the angle between said full-opening stopper surface and the engagement line of coupling, said coupling hole and coupling shaft when said nozzle vane is set at the full-opening position, and the distance between said full-opening stopper surface and the shaft center of said nozzle shaft when said nozzle vane is set at the full-opening position; and providing said nozzle angle regulator with a closing stopper surface provided on said joint member and said nozzle mount respectively, said closing stopper surfaces to contact each other at the minimum opening angle position of said nozzle vanes, in which said nozzle vanes stop at the minimum opening angle position, said closing stopper surfaces being defined by the angle between said closing stopper surface and the engagement line of coupling said coupling hole and coupling shaft when said nozzle vane is set at the minimum opening angle position, and the distance between said closing stopper surface and the shaft center of said nozzle shaft when said nozzle vane is set at the minimum opening angle position.

* * * * *